US007726497B1

(12) United States Patent
Updegrove et al.

(10) Patent No.: US 7,726,497 B1
(45) Date of Patent: Jun. 1, 2010

(54) REMOVABLE EXTERNALLY MOUNTED SLEWING CRANE FOR SHIPPING CONTAINERS

(75) Inventors: Darryl Updegrove, Panama City, FL (US); Garrett W. Leavitt, Panama City Beach, FL (US); James Ellington Sovel, Panama City Beach, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 76 days.

(21) Appl. No.: 12/380,881

(22) Filed: Mar. 2, 2009

(51) Int. Cl.
*B66C 23/18* (2006.01)

(52) U.S. Cl. ..... 212/179; 212/180; 212/225; 212/271; 414/543

(58) Field of Classification Search ..... 212/179, 212/180, 225, 270; 414/542, 543
See application file for complete search history.

(56) References Cited

U.S. PATENT DOCUMENTS 866,393 A * 9/1907 Shaw ..... 212/180
3,006,486 A * 10/1961 Gruble et al. ..... 414/542
3,482,715 A * 12/1969 Worthington ..... 414/542
3,572,513 A * 3/1971 Tantlinger et al. ..... 212/180
3,578,179 A * 5/1971 Fujioka ..... 212/180
4,002,243 A * 1/1977 Kramer ..... 212/225
4,249,853 A * 2/1981 Lyvers ..... 414/543

FOREIGN PATENT DOCUMENTS

FR 2490166 A * 3/1982

* cited by examiner

*Primary Examiner*—Thomas J. Brahan
(74) *Attorney, Agent, or Firm*—James T. Shepherd

(57) ABSTRACT

A slewing crane is assembled and installed at the end of a shipping and stowage container having block-shaped corner fittings. Left and right rotatable mounts engage top corner fittings on the container, and a cross piece section engages the rotatable mounts. A boom section has upper and lower hinges rotatably mounting it on the cross piece section via the hinges' axially aligned pins to extend outwardly from the cross piece section. A hoist on the boom section lifts and moves loads, and first and second displacement mechanisms connected to the boom section linearly displace the hoist and angularly displace the hoist and boom section in a slewing motion around the axis of the axially aligned pins. An element connected between the cross piece section and a corner fitting is tensioned by a turnbuckle to securely engage both rotatable mounts and hold the slewing crane on the container.

17 Claims, 7 Drawing Sheets

REMOVABLE EXTERNALLY MOUNTED SLEWING CRANE FOR SHIPPING CONTAINERS

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

This invention relates to a crane mounted on a shipping and stowage container. More particularly, this invention is for a slewing crane secured to the end of a shipping and stowage container utilizing powered and/or manual force for lifting/lowering loads, extending/retracting the loads and swinging or slewing the loads in the horizontal plane.

Containers are widely used in air, sea and land transport of goods since they keep many items together as a lot and protect them from damage during the haul. Large transport, vehicles can carry rows and columns of the containers that can rest singly or in stacks on decks and/or pallets.

The great majority of shipping and stowage containers in commercial air and maritime commerce have evolved into a standard design. The standard established by ISO 1161 requirements by the International Organization for Standardization defines containers of standardized dimensions and ruggedness to promote efficiency and safety for air and maritime use. The ISO 1161 containers are robustly constructed with rigid side walls mounted on strong frameworks that have a heavy-duty block-shaped corner fitting at each of the containers' eight corners. The corner fittings and other parts of an ISO 1161 container can be made of steel, aluminum or other tough material.

The ISO block-shaped corner fittings have outward facing elongated openings sized to receive appropriately dimensioned heavy-duty rotatable bayonet portions of standard single or double-cone twist-lock fittings. When a cone-shaped bayonet portion of a single or double-cone twist lock fitting is inserted through an opening and into an ISO 1161 corner fitting, the inserted portion is manually rotated a partial turn via an attached small twist-lock lever. This rotation of the inserted bayonet portion securely engages the twist-lock fitting to the block-shaped corner fitting, and when the other cone-shaped bayonet portion of the double-cone twist lock fitting is inserted through an opening and into a piece that needs to be interconnected, the other inserted portion is manually rotated a partial turn via an attached small twist-lock lever to secure the piece to the container. A considerable number of ISO 1161 corner fittings and interfacing standard single or double-cone twist-lock fittings are well known and commercially available.

Frequently, the need arises for strong lifting mechanisms at containers to help in the performance of work tasks in the area adjacent the containers or to help load or unload some goods to or from containers through one of their several closable openings. Currently, readily affixed mechanisms that are specifically designed for lifting/relocating items at the containers are not known. Typically, external non-fixed lifting equipment must be brought to the work site at the ends of shipping and stowage containers and there utilized to lift/move things. When such non-fixed lifting equipments are available on ships at sea, ship motions may make the use of such forklifts or portable hoists impractical and/or unsafe. In addition, some stowage compartments and holds on ships may have insufficient overhead clearance and/or capacity to mount an adequate lifting device to lift loads at the ends of the containers. Cranes potentially can be mounted internally in the shipping and stowage containers, but internally mounted cranes cannot slew the load past the plane projecting out from the vertical side wall of the container. Another limitation of internally mounting cranes in the containers is that they will consume too much valuable space inside the containers and compromise the amount of material that can be stowed and shipped. In addition, these internally mounted cranes can be fixed in size and may not be easily removable or further erectable to accommodate different sized containers.

Thus, in accordance with this inventive concept, a need has been recognized in the state of the art for a slewing crane externally mounted on a shipping and stowage container utilizing powered and/or manual force for lifting/lowering loads, extending/retracting the loads and swinging or slewing the loads in the horizontal plane.

SUMMARY OF THE INVENTION

The present invention provides a slewing crane assembled and installed at the end of a shipping and stowage container having block-shaped corner fittings on top corners. Left and right rotatable mounts engage top corner fittings on the container, and a cross piece section engages the rotatable mounts. A boom section has upper and lower hinges and is rotatably mounted on the cross piece section via axially aligned pins of the hinges to radially extend outwardly from the cross piece section. A hoist on the boom section lifts and moves loads, and first and second displacement mechanisms connected to the boom section linearly displace the hoist and angularly displace the hoist and boom section in a slewing motion around the axis of the axially aligned pins. A rod connected to the cross piece section is tensioned by a turnbuckle to securely engage both rotatable mounts to hold the slewing crane on the container and to compensate for loads supported by the hoist. The first and second displacement mechanisms include first and second chainfalls mounted on a boom-track member of the boom section. The first chainfall has an elongate threaded bolt shaped to engage a correspondingly threaded nut connected to the hoist on the boom-track member to linearly displace the hoist along the length of the boom-track member, and the second chainfall has an elongate threaded bolt on the cross piece section and the boom section shaped to engage a correspondingly threaded nut on the diagonal brace member of the boom section to angularly displace the hoist in an angular or rotational slewing motion around the axis defined by the axially aligned pins in an essentially horizontal plane at the end of the container.

An object of the invention is to provide a slewing crane secured to the end of a shipping and stowage container for supporting and moving loads.

Another object of the invention is to provide a slewing crane quickly secured to a shipping and stowage container to lift and displace loads.

Another object of the invention is to provide a slewing crane installed and secured to the end of a container in sections without requiring any ancillary heavy-lifting equipment.

Another object of the invention is to provide a slewing crane readily connectable to the ends of single or stacked shipping containers for lifting and moving loads.

Another object of the invention is to provide a slewing crane quickly and securely coupled to a shipping container by workmen to lift and move loads by powered and/or manual force.

Another object of the invention is to provide a slewing crane quickly secured to a shipping container with standard interfacing hardware to suspend and move loads in the area adjacent the container.

Another object of the invention is to provide a slewing crane quickly secured to a shipping container with standard interfaces and interfacing hardware and utilizing powered and/or manual force for lifting/lowering loads, extending/retracting the loads and swinging or slewing the loads in the horizontal plane.

These and other objects of the invention will become more readily apparent from the ensuing specification when taken in conjunction with the appended claims.

DESCRIPTION OF THE PREFERRED EMBODIMENT

Figure 1:
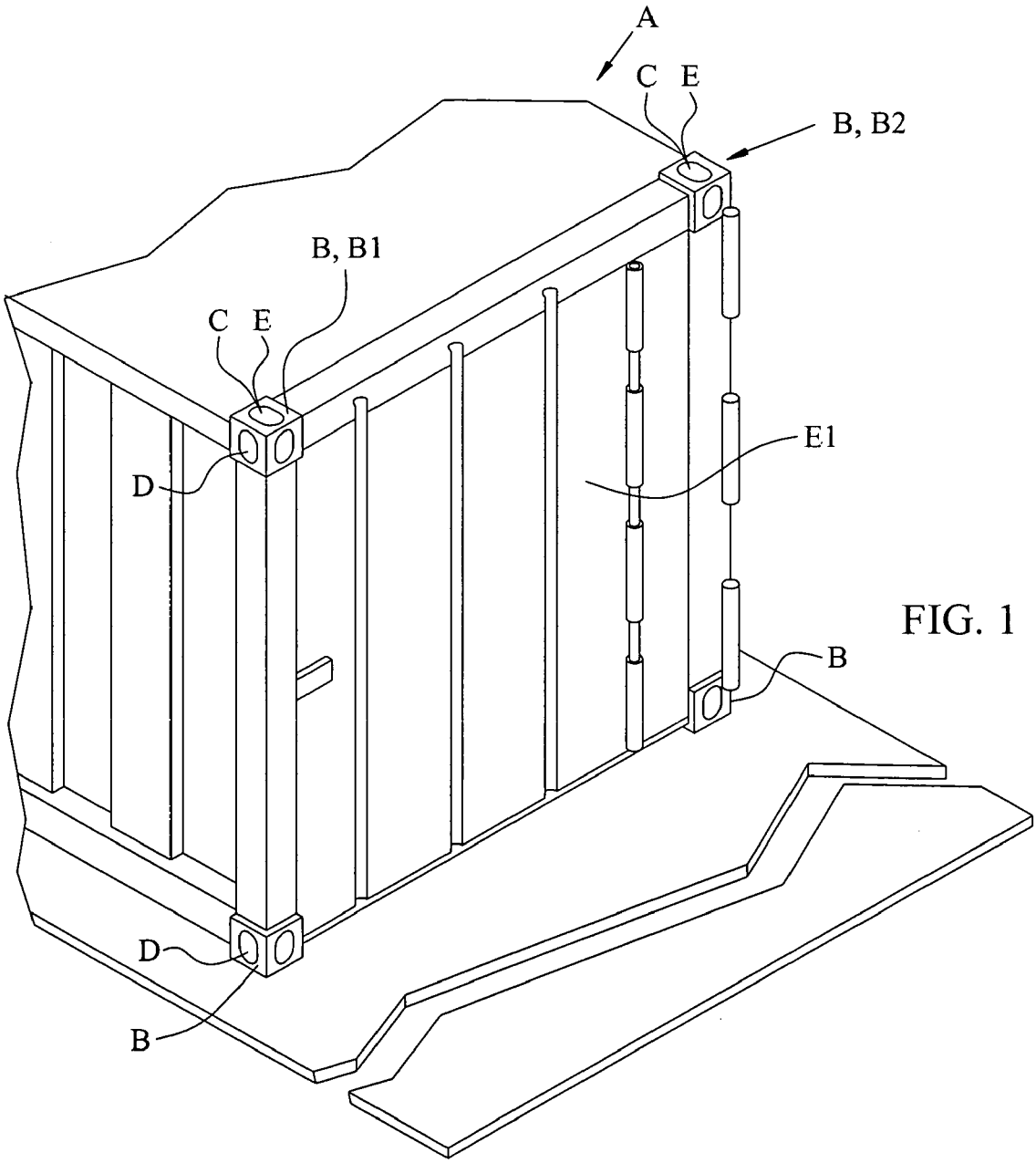
FIG. 1 shows one end of an ISO commercial shipping and stowage container having four ISO block-shaped corner fittings.
Figure 2:
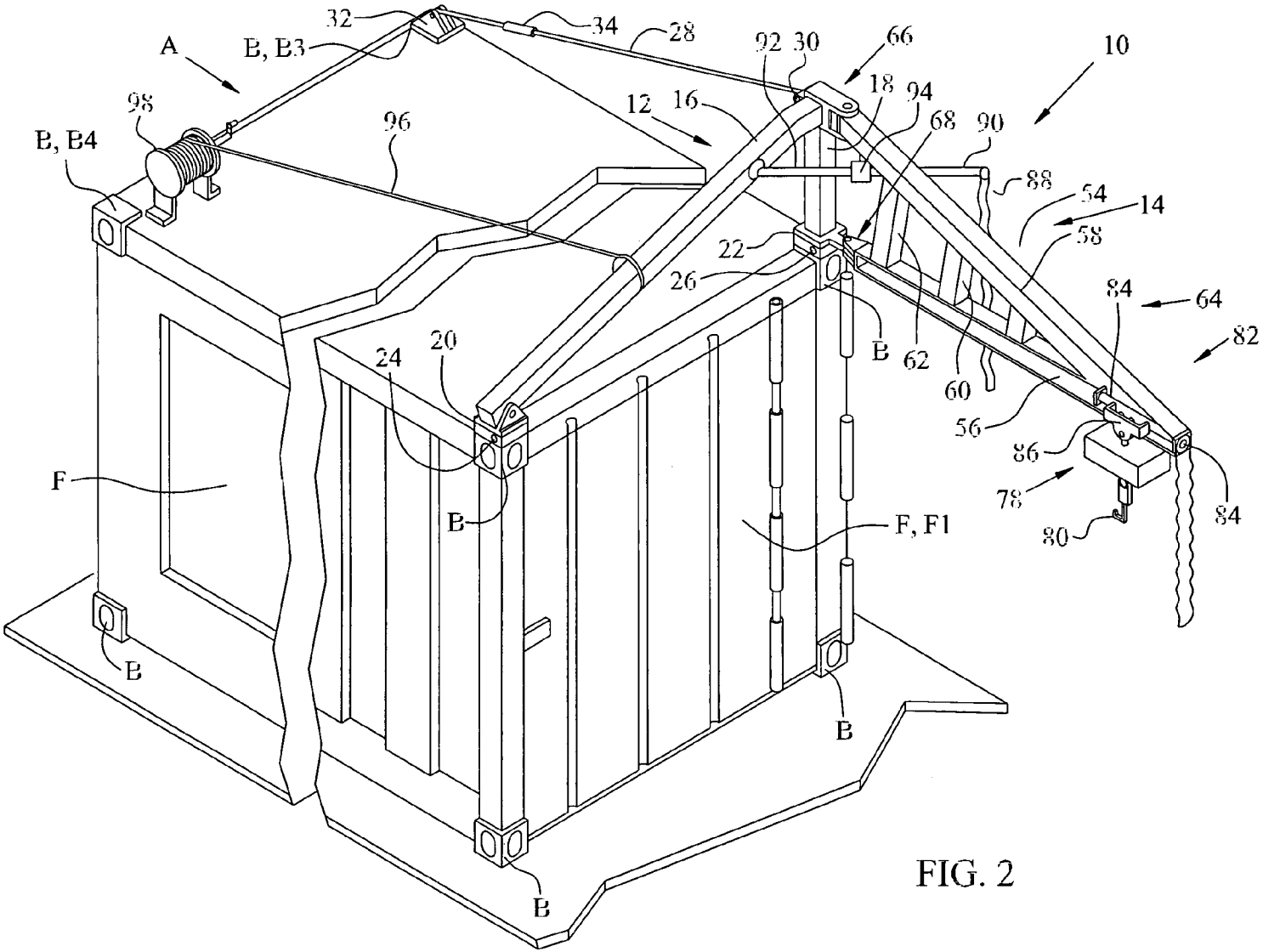
FIG. 2 is an isometric view of the ISO container securely mounting the slewing crane of the invention on upper block-shaped corner fittings.

Referring to FIGS. 1 and 2, slewing crane 10 of the invention is mounted at one end of a commercial shipping and stowage container A by its cross piece section 12 to position and support its boom section 14 at the container's end. Container A, an ISO 1161 shipping and stowage container for example, has a well known heavy-duty ISO block-shaped corner fitting B at each of the containers' eight corners, and each corner fitting B has an upward facing opening C as well as laterally aligned side openings D.

Slewing crane 10 of the invention is quickly assembled and securely attached to the upper ISO block-shaped corner fittings B1 and B2 at the end of container A by cross piece section 12 interfacing with upward facing openings C that each communicate with a hollow interior E of each corner fitting. Goods are transferred through doors F located on the sides and/or at ends of container A, end door F1 is shown closed in the FIGS. Slewing crane 10 can add, remove, and relocate goods in container A, and is also useful to support goods and/or other work-pieces at the right height and/or lateral/longitudinal position for further work or processing adjacent-to the container's end.

The structural components of cross piece section 12, boom section 14 and other parts to be described can be made from appropriately dimensioned solid or tubular aluminum, steel or other strong lightweight natural or man-made stock and/or materials selected by one of ordinary skill in the art to safely bear the expected loads and survive the harsh ambient conditions. In addition, the components of slewing crane 10 have been designed and made to be readily carried and installed on a designated container A by relatively unskilled workmen.

Figure 3:
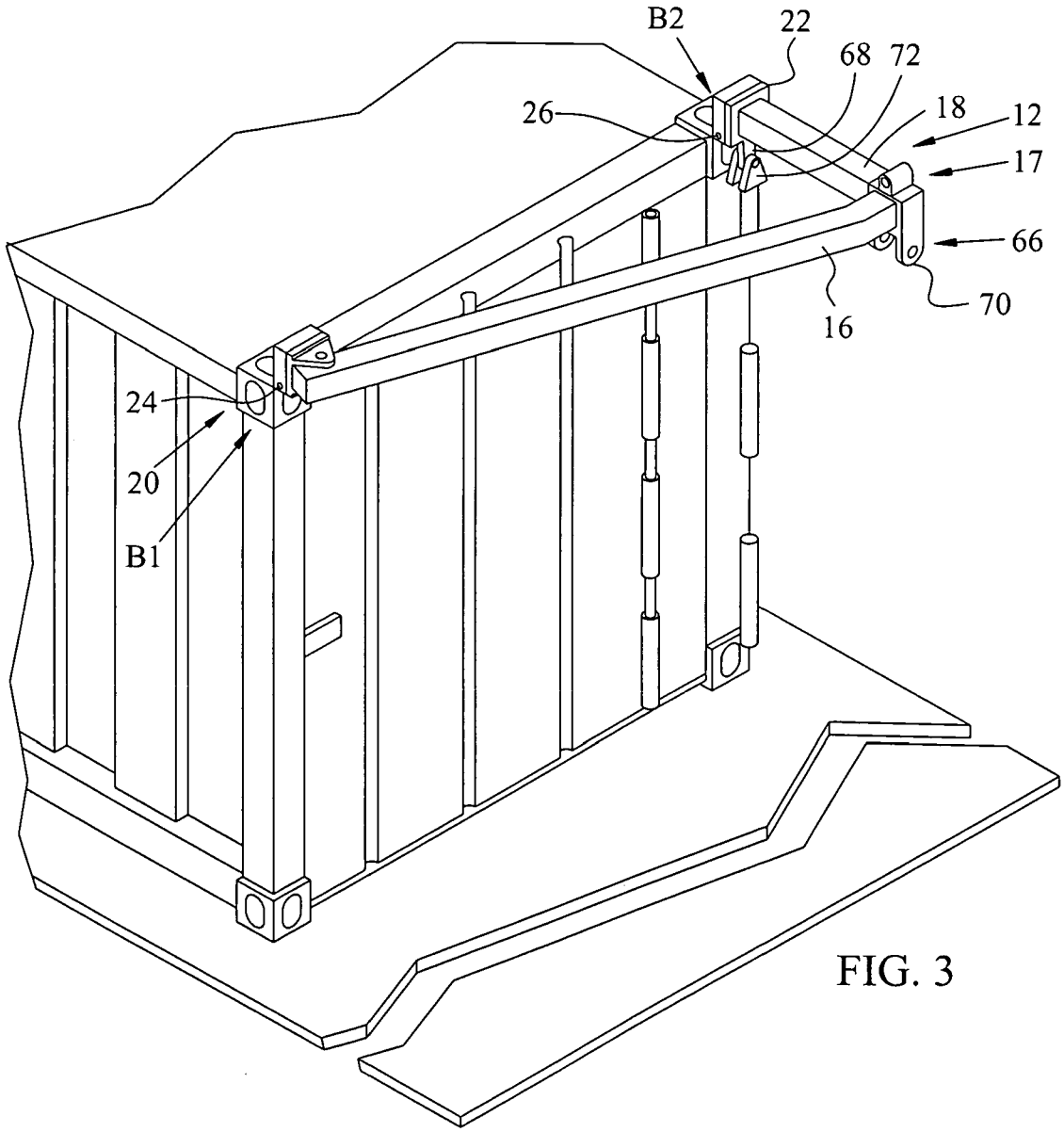
FIG. 3 shows partial mounting of the diagonal and vertical components of the cross piece section of the slewing crane on the shipping and stowage container via a left top mount inserted into and engaging the upper left one of the upper corner fittings and a right top mount inserted into and engaging the upper right one of the upper corner fittings.
Figure 6:
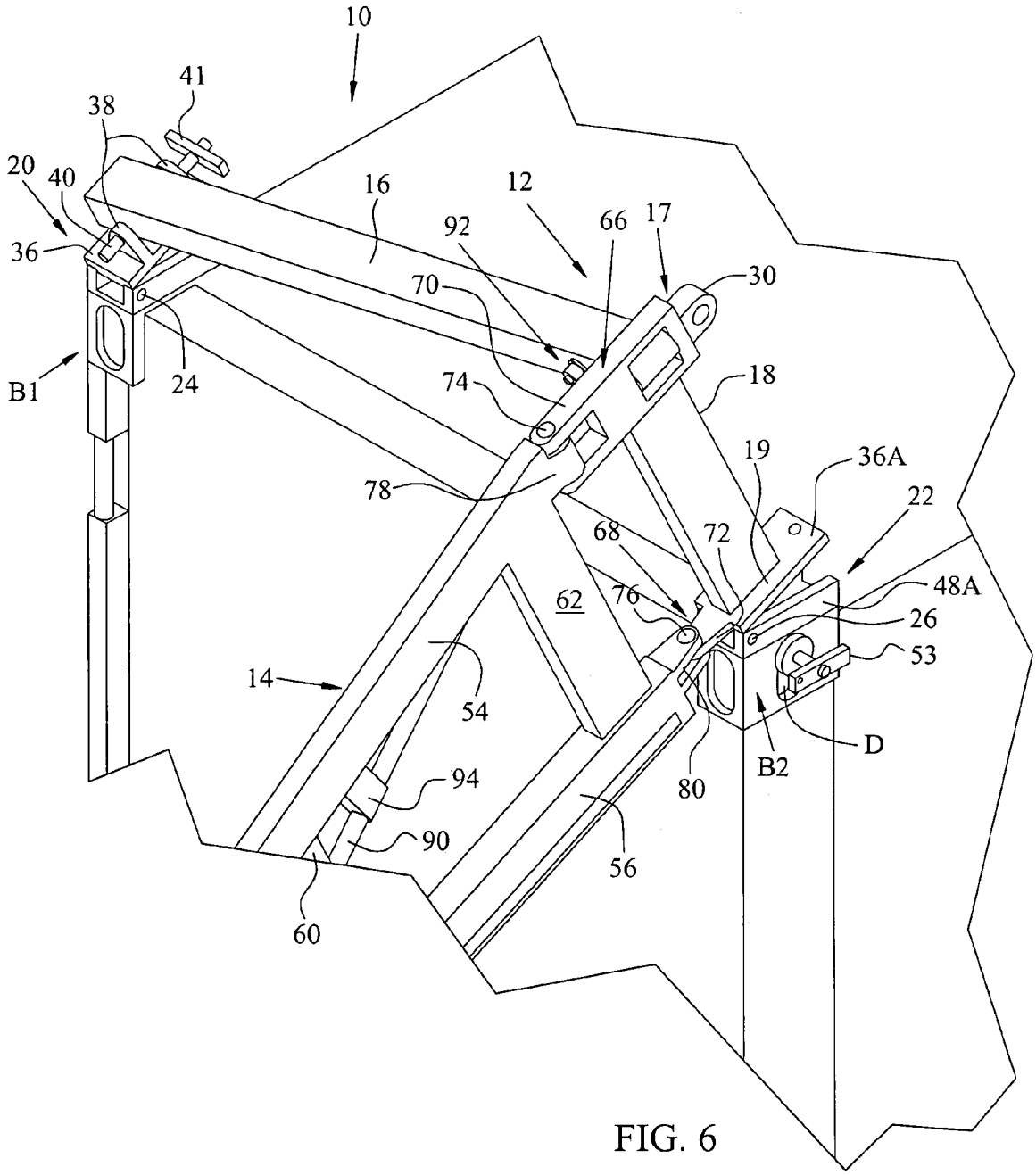
FIG. 6 is an enlarged view of the cross brace section on the rotatable mounts and connected to the boom section via hinges during installation of the slewing crane on the container.

Referring also to FIG. 3, cross piece section 12 of slewing crane 10 includes a diagonal component 16 interconnected via a articulative joint 17 to a vertical component 18, see also FIG. 6. Diagonal component 16 and vertical component 18 are respectively connected to a separate one of top block-shaped corner fittings B1 and B2 by left and right rotatable mounts 20 and 22. Rotatable mounts 20 and 22 are shown in FIG. 3 in the rotated-open position about hinge pins 24 and 26. This rotated open position occurs as slewing crane is being installed on container A and cross piece section 12 has just been attached to corner fittings B1 and B2. Rotatable mounts 20 and 22 are shown in FIG. 2 in the rotated-closed position about hinge pins 24 and 26 after installation and mounting of slewing crane 10 on container A has been completed.

Figure 4:
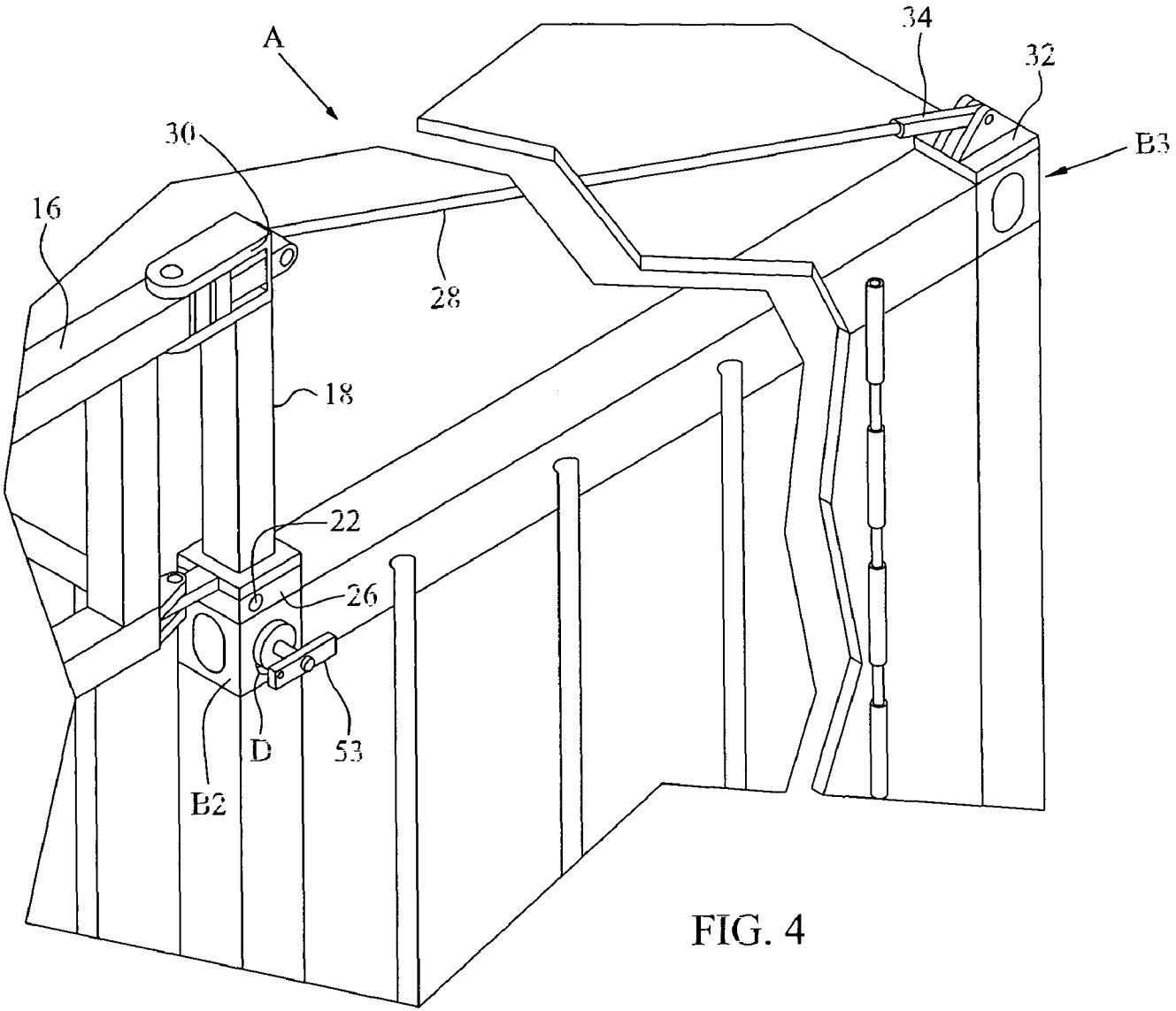
FIG. 4 is an isometric view of the tensioned rigid rod extending between the top of the vertical component of the cross piece section and the corner fitting located at the back end of the container.

Referring also to FIG. 4, after installation of slewing crane 10 on container A, it is securely held in place on fittings B1 and B2 by a tensioned elongate rigid structural element 28 such as a rod or cable. Rigid element 28 is connected at one end to a pad eye 30 at the upper end of vertical component 18 of 22 cross piece section 12 and is connected at its other end to a block-shaped corner fitting B3 at the rear of container A via any of a number of commercially available single twist or cam lock fittings or mount 32 similar to left and right mounts 20 and 22. Rigid element 28 not only secures cross piece section 12 of slewing crane 10 to container A but also functions to counteract or neutralize the torque created by the weight of slewing crane 10 and supported loads. A turnbuckle device 34 can be included to assure that sufficient tension is exerted in rigid element 28 to securely engage left and right mounts 20 and 22 in corner fittings B1 and B2 and hold components of slewing crane 10 on container A.

Figure 5:
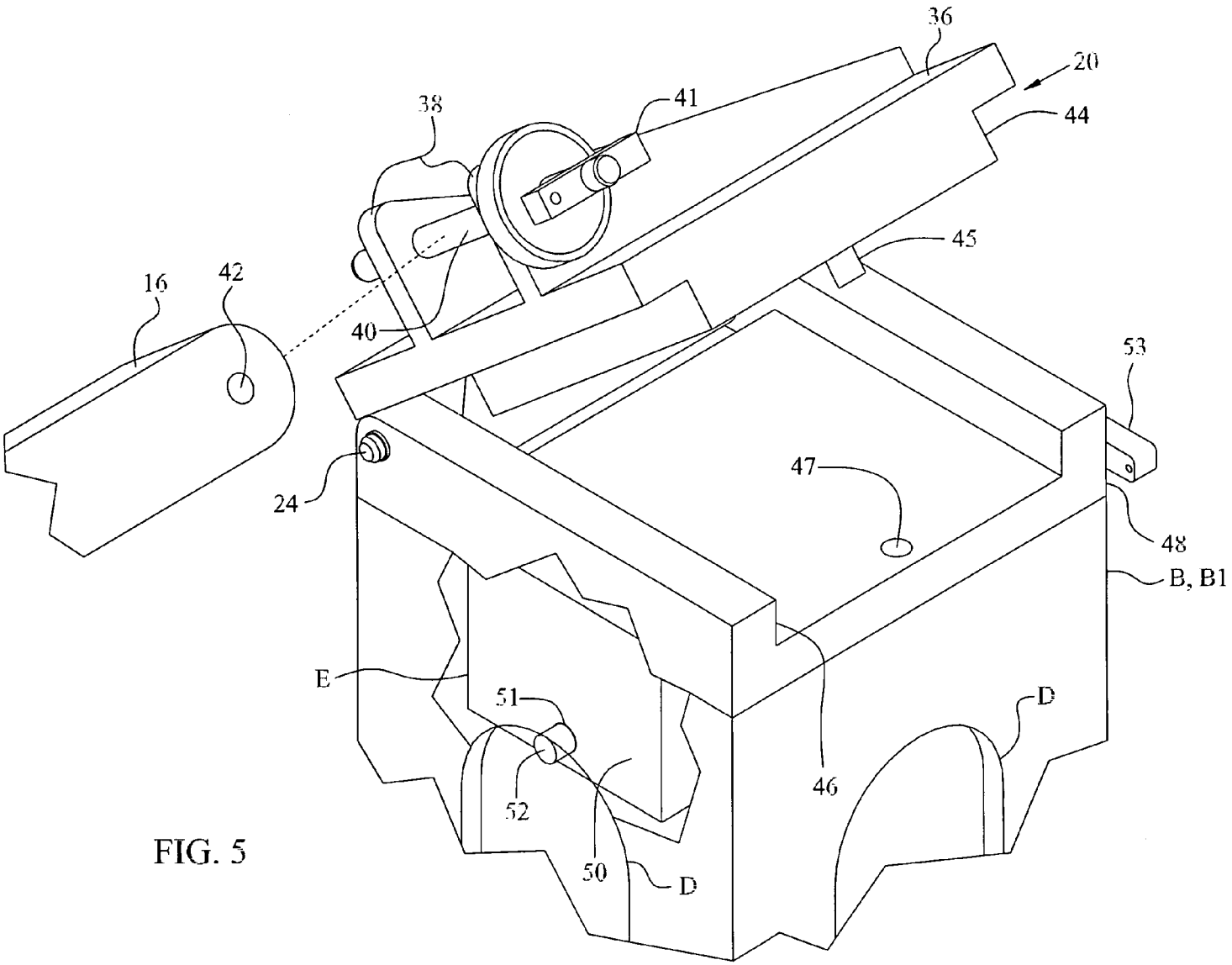
FIG. 5 is an exaggerated view of the left top mount as shown in FIG. 3 separated from the diagonal component of the cross piece section and rotated 180° about its vertical axis to show details thereof.

Mount 20 of FIG. 5 is exemplary and representative of mounts 20, 22 and 32 and will now be described in more detail. Mount 20 is shown separated from diagonal component 16 of cross piece section 12 and rotated 180° about its vertical axis to better show details of this exemplary design. It is understood that having the disclosure of slewing crane 10 of the invention in mind, other configurations of other mounts using these and other mechanical coactions could be made and used by one of ordinary skill within the scope of this invention.

Mount 20 has a relatively flat upper portion 36 having upward extensions 38 provided with aligned bores that slideably guide an elongate pin 40 through them when it is axially displaced by an attached handle 41. When a lateral bore 42 of diagonal component 16 is interposed between and aligned with the aligned bores in upward extensions 38 of mount 20, displacement of elongate pin 40 by handle 41 through bored upward extensions 38 permits selective engagement and disengagement of diagonal component 16 by mount 20.

Upper portion 36 of mount 20 has a lateral ridge 44 and hold-down bolt 45 to fit into and be accommodated by a mating groove 46 and recess 47 in a lower portion 48 of mount 20 when upper portion 36 is rotated about hinge pin 24 onto lower portion 48 to the closed position shown in FIG. 2. A downward projecting block 50 integrally extending from lower portion 48 is sized to be fitted through upward facing opening C to extend into hollow interior E of corner fitting B1. A lateral pin 52 can be inserted through a lateral hole 51 in block 50 and through a side opening D of corner fitting B1 by a handle 53 to selectably laterally extend through and across integral block 50 and through laterally aligned side openings (only one of which D being shown) in corner fitting B1. This engagement of the upper edge of side opening D by lateral pin 52 secures mount 20 in corner fitting B1.

When upper portion 36 has been rotated to the closed position and rigid element rod 28 is connected and tensioned, the tension exerted by element 28 securely holds mount 20 shut. Being held shut by element 28 and the mating co-action of the mating parts of upper and lower portions 36 and 50 and integral block 50, lateral pin 52 and corner fitting B1, diagonal component 18 of cross piece section 12 and the rest of mount 20 are secured in both the vertical and horizontal directions.

Referring also to FIG. 6, mount 22 is made and operates much the same as mount 20 with the exception that mount 22 does not have upward extensions 38. Instead upper portion 36A of mount 22 is welded to the base 19 of vertical component 18 of cross piece section 12 and lower portion of mount 22 has its lower portion 48A and associated structure engaging corner fitting B2 via a lateral pin connected to handle 53. Mount 22 and mount 20 can rotate about their hinge pins 26 and 24 from the open position shown in FIG. 6 during installation of slewing crane 10 on container A to the closed position as shown in FIG. 2. Rigid element 28 can then be connected and tensioned to hold cross piece section 12 in a vertical upright orientation and extend boom section 14 outwardly in a horizontal direction from the upper edge of the container.

Boom section 14 has a diagonal brace member 54 connected to a boom-track member 56 by three cross-brace members 58, 60 and 62, as shown in FIGS. 2 and 6. These members are arranged and secured in an essentially triangularly-shaped form that has upper and lower hinges 66 and 68 to rotatably couple cross piece section 12 and boom section 14 together. Hinge portions 70 and 72 of hinges 66 and 68 on vertical component 18 are rotatably joined via axially aligned hinge pins 74 and 76 to mating upper and lower hinge portions 78 and 80 on diagonal brace member 54 and boom-track member 56. This hinged interconnection allows boom section 14 to rotatably or angularly slew about the axis of aligned hinge pins 74 and 76 at vertical component 18 in an essentially horizontal plane at the end of the container.

Boom-track member 56 of boom section 14 receives and supports a hoist 78 for engaging, raising, lowering and moving loads engaged by its hook 80. Hoist 78 is shaped to travel and be supported along the length of boom-track member 56 in radially outward and inward excursions. Hoist 78 has appropriately interconnected and operator-controllable electric motor/pneumatic/hydraulic/manual means to effect raising and lowering of loads on hook 80 by a workman at the work site.

Hoist 78 can be a well known commercially available powered unit connectable to an electrical power source and operated by a relatively untrained workman. A typical hoist unit that could be used is a Model 3505 Lodestar Electric Two-Speed 1 Ton Hoist coupled with a Model 3677 Suspension and Model 3575 Low Headroom Trolley, all manufactured by Columbus McKinnon Corporation, 140 John James Parkway, Amherst, N.J. 14228, to raise, support and lower loads. Other readily available models could be selected depending on the expected loads, power availabilities, and other considerations of the work site.

A first chainfall 82 is mounted on the outer end of boom-track member 56 and allows a workman to selectively displace hoist 78 in inward/outward displacements along boom-track member 56. Chainfall 82 displaces hoist 78 by any of a number of well known mechanical linkages. For example, a rotatable first elongate threaded rod 84 also known as an acme screw is supported in a journal (not shown) at its inner end and extends the length of member 56 to threadably engage a correspondingly threaded acme screw nut 86 connected to hoist 78. Selectively bidirectionally rotating first chainfall 82 connected to rod 84 displaces hoist 78 in responsive linear directions on boom-track member 56 to bidirectionally displace a load hanging on hook 80.

A second chainfall 88 is connected to a second rotatable elongate threaded rod 90 supported at its inner end in a journal mount 92 on diagonal component 16 of cross piece section 12 that supports and permits rotation of rod 90. Threaded rod 90 threadably engages a correspondingly threaded acme screw nut 94 secured to diagonal brace member 54. Selectively bidirectionally rotating second chainfall 88 connected to rod 90 engaging nut 94, angularly displaces boom section 14 including hoist 78 and any attached loads in responsive rotational angular displacements about the vertical axis of aligned hinge pins 74 and 76 of hinges 66 and 68.

The structures associated with first and second chainfalls 82 and 88 for linearly displacing hoist 78 and angularly displacing boom section 14 are only exemplary of a number of well known means for effecting such linear and angular displacements from rotational displacements of chainfalls 82 and 88. It is in the purview of one of ordinary skill to select other effective mechanical arrangements that may include small controlled motor-driven mechanisms and other appropriately interconnected and operator-controllable electric motor/pneumatic/hydraulic/manual mechanisms/assemblies to effect bidirectional displacements of hoist 78 on boom-track member 56 and angular displacements of member 56.

Slewing crane 10 of the invention can be expediently assembled and installed at the end of container A without any elaborate, propelled heavy-lifting equipment by relatively unskilled workmen to enable quick, efficient loading or unloading of goods at the container. Assembly and installation of slewing crane 10 requires no other power machinery and it can be installed in sections to reduce the overall weight and size of hardware that needs to be moved at any given time.

Slewing crane 10 can be assembled at the work site adjacent container A from all the component parts described above. However, complete assembly at a work site may not be efficient and take too much time when quick transfer of goods is needed. One of the salient features of slewing crane 10 is that its cross piece section 12 and boom section 14 can be individually preassembled at a centralized workshop, held in inventory until needed, and brought to the work site for final assembly and installation on a container. A further option is that the components of cross piece section 12 and boom section 14 can be pre-assembled in other combinations, or they could be brought as separate pieces or smaller subassemblies for ease of transport to the work site and final assembly can be completed there.

During installation of slewing crane 10 on container A, cross piece section 12 is carried to the end of container A, raised to the top of the container by workmen, and mounts 20 and 22 are inserted into and connected to upper block-shaped corner fittings B1 and B2, see FIG. 3. Cross piece section 12 extends rotated about mounts 20 and 22 with hinge portions 70 and 72 of upper and lower hinges 66 and 68 facing downward, see FIG. 6. Boom section 14 is brought by workmen near the end of container A, and since hoist 78 is likely to be the heaviest component, it is placed at the outer end of boom-track member 56 to rest on the ground, see FIG. 7. Now, the workmen pick up boom section 14, mating hinge portions 78 and 80 of hinges 66 and 68 are maneuvered to align with hinge portions 70 and 72, and hinge pins 74 and 76 are inserted to rotatably couple cross-piece section 12 and boom sections 14 together, also see FIG. 6.

Figure 7:
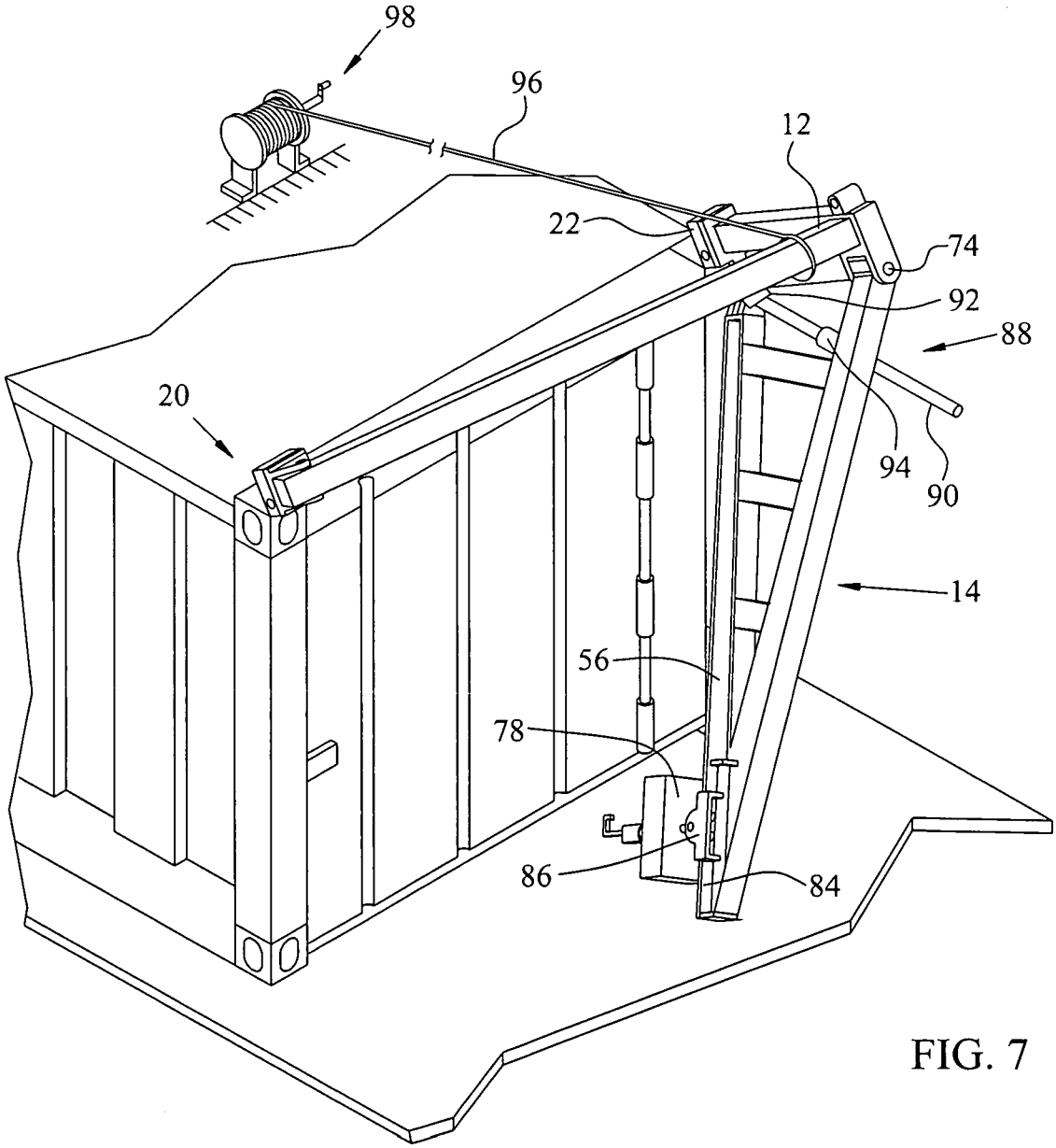
FIG. 7 shows the slewing crane during installation with the cross piece section mounted on the container and the pivotally connected boom section having the hoist resting on the deck.

Referring also to FIG. 7 a cable 96 extends from a hand-powered winch 98 that can be mounted on a solid anchoring footing adjacent the other end of container A, or hand-powered winch 98 might be mounted adjacent block-shaped corner fitting B4 at the other end of container A, see FIG. 2. Cable 96 from hand winch 98 is connected to diagonal component 16. Rotation of hand winch 98 by the workmen tensions cable 96 to rotate and raise cross piece section 12 and boom section 14 of slewing crane 10 about hinge pins 24 and 26 of mounts 20 and 22 to the upright rigid position shown in FIG. 2. Now, element 28 is connected to corner fitting B3 and pad eye 30 on vertical component 18 of cross piece 12, and turnbuckle device 34 is rotated to match or exceed the tension of cable 96 so that cable 96 can be disconnected from diagonal component 16. Slewing crane 10 is now ready to perform loading and unloading of goods for container A and the tension in element 28 can be increased to compensate for loads connected to hoist 78 by further tightening turnbuckle device 34.

Loads on hoist 78 can be linearly extended from and retracted to container by selective rotation of first chainfall 82 and loads on hoist 78 can be angularly rotated or moved from one side to another by selective rotation of second chainfall 88 or a combination of rotations from both chainfalls 82 and 88 can be utilized to precisely engage and move goods to selected positions at the end of container A. Movement by chainfalls 82 and 88 need not be restricted to the acme screw-nuts, gear driven wheels, or other manually operated mechanisms and one skilled in the art could use many well known controllable motor-driven powered subassemblies for moving hoist 78 as desired.

All components of slewing crane 10 of the invention can be made from a wide variety of tough non-corrosive or corrosion resistant materials to survive in harsh environments where containers A are used. Modifications and alternate embodiments of slewing crane 10 of the invention may be adapted for other containers. In addition to the highly functional crane structure described, slewing crane 10 of the invention could have different shapes, sizes and materials to create other user-friendly lifting structures.

The disclosed components and their arrangements as disclosed herein, all contribute to the novel features of this invention. Slewing crane 10 of the invention gives relatively unskilled workmen the capability to effectively load and unload standardized containers in confining storage areas. Therefore, slewing crane 10 of the invention, as disclosed herein is not to be construed as limiting, but rather, is intended to be demonstrative of this inventive concept.

It should be readily understood that many modifications and variations of the present invention are possible within the purview of the claimed invention. It is to be understood that within the scope of the appended claims the invention may be practiced otherwise than as specifically described.

We claim:

1. An apparatus for lifting and moving loads at the end of a shipping and stowage container having block-shaped corner fittings at upper top corners at its ends comprising:

left and right rotatable mounts;

means for detachably coupling said left and right rotatable mounts to separate block-shaped corner fittings at the top of one end of said container;

a cross piece section coupled to said rotatable mounts;

a boom section having upper and lower hinges, said boom section being rotatably mounted on said cross piece section via axially aligned pins of said upper and lower hinges and outwardly extending from said cross piece section;

a hoist mounted on said boom section for lifting and moving engaged loads; and first and second displacement mechanisms connected to said boom section for linearly displacing said hoist and angularly displacing said hoist and boom section in a slewing motion around the axis defined by said axially aligned pins, respectively.

2. The apparatus of claim 1 further comprising:

an elongate rigid structural element connected between said cross piece section and a block-shaped corner fitting at the rear of the container.

3. The apparatus of claim 2 further comprising:

a turnbuckle device connected to said rigid structural element to create tension in said rigid structural element, said tensioned structural element assuring secure engagement of said rotatable mounts in corner fittings at the front of the container and holding said cross piece section and said boom section on the container.

4. The apparatus of claim 3 wherein said cross piece section includes a diagonal component connected to a vertical component having a pad eye at its upper end, one end of said diagonal component is shaped to engage said left rotatable mount and a base of said vertical component is secured to said right rotatable mount.

5. The apparatus of claim 4 wherein said rigid structural element is shaped to engage said pad eye and said turnbuckle device is disposed to be tightened to increase tension in said rigid structural element to compensate for loads supported by said hoist.

6. The apparatus of claim 5 wherein said boom section includes a diagonal brace member connected to a boom-track member by a plurality of cross-brace members in an essentially triangularly-shaped form and said hoist is mounted on said boom-track member.

7. The apparatus of claim 6 wherein said upper and lower hinges are shaped to rotatably couple said cross piece section and said boom section via hinge portions of said upper and lower hinges on said vertical component of said cross piece section through said axially aligned hinge pins to mating hinge portions on said diagonal brace member and said boom-track member of said boom section for angular slewing of said hoist on said boom section.

8. The apparatus of claim 7 wherein said hoist is shaped to be mounted on said boom-track member and said first and second displacement mechanisms are first and second chainfalls mounted on said boom-track member.

9. The apparatus of claim 8 wherein said first chainfall includes an elongate threaded bolt shaped to engage a correspondingly threaded nut connected to said hoist on said boom-track member to linearly displace said hoist along the length of said boom-track member and said second chainfall includes an elongate threaded bolt on said cross piece section and said boom section shaped to engage a correspondingly threaded nut on said diagonal brace member to angularly displace said hoist around the axis defined by said axially aligned pins in an essentially horizontal plane at the end of the container.

10. The apparatus of claim 1, wherein said means for detachably coupling comprises:

a block projecting downward from each said rotatable mount and sized to fit through an upward facing opening in its corresponding block-shaped corner fitting, said downward projecting block having a lateral hole that can be accessed through a side opening in said block-shaped corner fitting; and a pin having a diameter smaller than said lateral hole and sufficient length to extend completely through said lateral hole and through at least one side opening of said block-shaped corner fitting to prevent said rotatable mount from disengaging from said block-shaped corner fitting.

11. A method of lifting and moving loads with a slewing crane at the end of a shipping and stowage container having block-shaped corner fittings at upper top corners at its ends comprising the steps of:

engaging separate block-shaped corner fittings at one end of the container with a separate one of left and right rotatable mounts;

engaging said left rotatable, mount and said right rotatable mount on separate corner fittings with a cross piece section of a slewing crane;

rotatably mounting a boom section having upper and lower hinges on said cross piece section via axially aligned pins of said upper and lower hinges;

outwardly extending said boom section from said cross piece section;

mounting a hoist on said boom section for lifting and moving loads engaged thereby;

linearly displacing said hoist by a first displacement mechanism connected to said boom section; and angularly displacing said hoist and boom section in a slewing motion around the axis defined by said axially aligned pins by a second displacement mechanism connected to said boom section.

12. The method of claim 11 further comprising the step of:

connecting an elongate rigid structural element at one end to said cross piece section and at its other end to a block-shaped corner fitting at the rear of the container.

13. The method of claim 12 further comprising the steps of:

connecting a turnbuckle device to said rigid structural element;

tensioning said rigid structural element with said turnbuckle device;

securely engaging each of said left and right rotatable mounts in a separate block-shaped corner fitting at the front of the container; and holding said cross piece section and said boom section on the container.

14. The method of claim 13 further comprising the steps of:

including a diagonal component connected to a vertical component having a pad eye at its upper end in said cross piece section;

shaping one end of said diagonal component to engage said left rotatable mount; and securing a base of said vertical component to said right rotatable mount.

15. The method of claim 14 further comprising the steps of:

coupling said rigid structural element to said pad eye; and tightening said turnbuckle device to increase tension in said rigid structural element to compensate for loads connected to said hoist.

16. The method of claim 15 further comprising the steps of:

providing a diagonal brace member connected to a boom-track member by a plurality of cross-brace members arranged and secured in an essentially triangularly-shaped form in said boom section; and outwardly extending said boom-track member and said hoist from said vertical component.

17. The method of claim 16 further including the step of:

rotatably coupling said upper and lower hinges on said cross piece section and said boom section together via hinge portions of said upper and lower hinges on said vertical component of said cross piece section through said axially aligned hinge pins to mating hinge portions on said diagonal brace member and said boom-track member of said boom section to allow angular slewing of said hoist on said boom section.

* * * * *